US006320148B1

(12) United States Patent
Yoon et al.

(10) Patent No.: US 6,320,148 B1
(45) Date of Patent: Nov. 20, 2001

(54) ELECTROSTATIC METHOD OF SEPARATING PARTICULATE MATERIALS

(76) Inventors: Roe-Hoan Yoon, 2909 Wakefield Dr., Blacksburg, VA (US) 24060; Oh-Hyung Han, 101-906 Pungam-Dong Kumbo Apt Ave 1 Suh-ku, Kwangju (KR); Eric S. Yan, 7595 Baymeadows Cir. West, Apt. 2709, Jacksonville, FL (US) 37256; Byung-Wook Park, 432-1280 Shindang-2-dong, Pacific A-202 Seoul (KR)

( * ) Notice: Subject to any disclaimer, the term of this patent is extended or adjusted under 35 U.S.C. 154(b) by 0 days.

(21) Appl. No.: 09/368,945

(22) Filed: Aug. 5, 1999

(51) Int. Cl.[7] ..... B03C 7/00

(52) U.S. Cl. ..... 209/127.3; 209/128; 209/131; 209/920

(58) Field of Search ..... 209/127.1, 127.3, 209/128, 129, 130, 131, 920

(56) References Cited

U.S. PATENT DOCUMENTS

| | | | | |
|---|---|---|---|---|
| 2,116,613 | | 5/1938 | Bedford . | |
| 3,407,930 | | 10/1968 | Morel et al. . | |
| 3,720,312 | * | 3/1973 | Shook et al. | 209/130 |
| 3,885,119 | * | 5/1975 | Sargeant | 209/127.3 X |
| 4,274,947 | | 6/1981 | Beeckmans et al. . | |
| 4,357,234 | * | 11/1982 | Inculet et al. | 209/128 X |
| 4,374,727 | * | 2/1983 | Takahashi et al. | 209/128 X |
| 4,514,289 | | 4/1985 | Inculet . | |
| 4,517,078 | | 5/1985 | Inculet et al. . | |
| 4,556,481 | | 12/1985 | Hepher . | |
| 4,839,032 | | 6/1989 | Whitlock . | |
| 4,874,507 | | 10/1989 | Whitlock . | |
| 5,513,755 | | 5/1996 | Heavilon et al. . | |
| 5,755,333 | | 5/1998 | Stencel et al. . | |
| 5,819,946 | | 10/1998 | Whitlock et al. . | |
| 5,885,330 | | 3/1999 | Lee . | |
| 5,904,253 | | 5/1999 | Cerullo et al. . | |

FOREIGN PATENT DOCUMENTS

| | | | | |
|---|---|---|---|---|
| 1810114 | * | 4/1993 | (SU) | 209/127.3 |

* cited by examiner

*Primary Examiner*—Tuan N. Nguyen
(74) *Attorney, Agent, or Firm*—James W. Hiney

(57) ABSTRACT

A method of separating particulate materials of different properties has been developed. It consists of feeding a mixture of dry, powdered materials to one end of the surface of a planar electrode, which is vibrating to move the particles forward. At least one type of the particulate materials acquires a charge via conduction or triboelectrification. Those particles that acquire charges of the same sign as that of the planar electrode are lifted and collected at the V-shaped counter electrodes installed above. The new separation method is particularly useful for removing unburned carbons from fly ash and any other conducting materials from nonconducting ones.

17 Claims, 2 Drawing Sheets

ELECTROSTATIC METHOD OF SEPARATING PARTICULATE MATERIALS

BACKGROUND

Two different particulate materials can be separated from each other, if they can be charged differently and placed in an electric field. In one method of separation, corona charges are sprayed over a mixture of conducting and non-conducting particles flowing along the surface of a rotating metal drum. The charges sprayed on the conducting particles dissipate quickly through the drum (which is grounded) and are thrown off, while the non-conducting particles retain the charges and held to the drum surface by image forces. This method is referred to as electrodynamic separation, and is widely used for the beneficiation of potash and heavy minerals.

In another, a mixture of conducting and non-conducting particles is fed close to an electrode over a metal plate, which is grounded. The conducting particles are polarized in the electric field near the electrode and lose the charges of the same sign as that of the electrode to the metal plate, thereby acquiring a net charge opposite in sign to that of the electrode. The conducting particles are then lifted off the feed plate, while the non-conducting particles continue to move forward. This method is referred to as true electrostatic separation, and is widely used for separating strip wires from plastics and separating heavy minerals in beach sands.

In still another method, particles are contacted with a surface (e.g., the walls of a reactor) and acquire positive or negative charges depending on their work functions relative to that of the surface. By choosing a plate whose work function is in between those of the two different particulate materials to be separated, one can achieve separation. This method is referred to as triboelectrostatic separation. The U.S. Pat. No. 5,885,330 describes methods of using this technique for the removal of unburned carbons from fly ash. The same technique is also employed in the U.S. Pat. 5,755,333, in which triboelestrostatically charged particles are separated in a combined force field of electrostatic attraction and centrifugation. These methods were used for the beneficiation of fly ash.

The U.S. Pat. No. 3,407,930 and 4,274,947 showed that particulate materials also acquire triboelectric charges when they are agitated in a fluidized bed. The charged particles are then separated by creating an electrostatic field across the bed, the particles attracted by the electrodes being removed by means of a moving belt electrode. In the U.S. Pat. No. 4,839,032 and 4,874,507, particles acquire triboelectric charges by a vigorous agitation created by a belt moving in between two closely-spaced electrodes (less than 10 mm apart). The charged particles attracted to the positive and negative electrodes move toward opposite directions and are collected separately. Belt wears rather quickly; however, methods of minimizing it have been disclosed in the U.S. Pat. No. 5,819,946 and 5,904,253. These belt separators were tested for removing unburned carbons from fly ash.

In still another method, conducting particles are charged by contacting an electrode and are then separated from noncondcuting particles in an electric field. The U.S. Pat. No. 2,116,613 disclosed a method of feeding a mixture of particles of differing conductivities through a conducting chute electrified to a high potential, whereby a charge is acquired condcutively or by contact. The charged particles are then attracted by an oppositely charged electrode located underneath.

The U.S. Pat. No. 4,357,234 disclosed a similar method of charging particles and separating the charged particles from uncharged ones in an alternating current electric field of nonuniform intensity. In this invention, particles are fed to the surface of a flat electrode installed horizontally. An electromagnetic vibrator is installed underneath the horizontal electrode to move the particles forward. According to the inventors, the particles acquire charges either by triboelectrification or by conductive induction. The charged particles are then attracted toward the oppositely charged electrode. Since the electrodes are connected to an AC power supply, the charged particles oscillate between the two electrodes, i.e., they are in suspension. At the same time, the particles are subjected to a centrifugal force created by the nonuniform electric field, which in turn is created by installing the upper electrode with an angle to the bottom electrode. Thus, the charged particles move toward the direction transverse to the forward movement of nonconducting particles. Similar methods are disclosed in the U.S. Pat. No. 4,514,289 and 4,517,078. In the U.S. Pat. No. 4,556,481, the bottom electrode is made of sintered metal, so that air can be sparged to help suspend particles in the nonuniform electric filed.

The U.S. Pat. No. 5,513,755 disclosed a method of removing unburned carbons from fly ash by using a technique similar to that described in the foregoing paragraph, except that the electric field is created by a DC rather than an AC power supply. In this method, a fly ash feed is heated at a high temperature such that the surface temperature may be in the range of 250 to 600° F. or higher. The heated fly ash is then fed to the upper surface of a conveyer belt, which is made of a conductive material, so that it can serve as an electrode. A counter electrode located above the belt electrode is shaped such that the distance between the upper and lower electrodes are larger the marginal edges of the belt than at the center of the belt. Such electrode geometry allows carbon particles move transversely of the belt movement, possibly due to the centrifugal force and the airflow caused by the ionization of the air in between the two electrodes. The electrical field in between the upper and lower electrode is higher than 2,000 V per inch. The lower belt is subjected to a low frequency mechanical vibration (100 to 800 impulses per minute), which is created using a multiplicity of rectangular beaters installed beneath the moving belt electrode. The mechanical vibration rearranges the orientation of the carbon particles so that they rise to the top of the layer of the particles by reason of their lightweight and, thus, become charged inductively. The charged particles are then subjected to the nonuniform electric field of separation.

The various electrostatic separation methods described above may be useful for removing unburned carbons from fly ash. They have inherent advantages over flotation in that the latter is a wet process, which entails high costs of dewatering. In 1996, the U.S. produced 59.6 million tons of fly ash, approximately 20% of which was recycled for productive use. Bulk of the recycled fly ash was used to replace pozzolans in Portland cement and as fillers in plastic and asphalt manufacture. The amounts of fly ash used in these applications are in the range of 15 to 35%. One of the problems in recycling fly ash as pozzolan is the amount of the unburned carbon left in it. Loss on ignition (LOI) is a common measure of the unburned carbon in fly ash, and the ASTM C114 describes a standard method of determining it. The unburned carbons in fly ash consume air-entraining agents used in concrete. They also affect pozzolanic reactivity and weaken the strength of concrete. Therefore, ASTM C-618-92a limits maximum LOI for Class F and C fly ashes to 6%. It is desirable, however, to further reduce the LOI of a fly ash preferably to below 3% using appropriate beneficiation methods to increase its marketability. The electrostatic separators described above are also useful for separating small amount of conducting materials mixed with noncondcuting materials, e.g., sulfide minerals present in siliceous tailings.

SUMMARY OF THE PRESENT INVENTION

The present invention provides a method of separating particulate materials of different properties admixed with each other. The separation is achieved by rendering a selected material electrically charged and separating them from others in an electric field. The process consists of feeding the mixture to one end of a planar electrode surface and allowing the particles to move to the other end by vibrating the electrode. A preferred means of vibration would be to attach an electromagnetic vibrator underneath the electrode, whose vibrational frequencies are in the range of 30 to 60 Hz. The velocity of forward movement of the particles may be controlled by changing the frequency and amplitudes of the vibration. Also, the planar electrode may be installed with an angle, so that the particulate material can flow more readily. Some of the particles flowing along the planar electrode acquire electrical charges while others do not, depending on their physical properties. Conducting particles, such as the unburned carbons in fly ash, acquire charges by conduction in preference to the nonconducting fly ash particles. It is possible, however, that nonconducting particles may also acquire charges by the triboelectrification mechanism, depending on the work functions of the particles relative to that of the electrode.

A conducting particle, such as carbon in fly ash, should acquire charge which is of the same sign as that of the electrode with which it is in contact. The charge increases as the particle bounces along the surface of the bottom electrode. The higher the frequency of vibration, the higher the number of contacts and, hence, the charge should become. When the charge becomes sufficiently high relative to the mass of the particle, it will be repelled from the electrode and at the same time be attracted by the counter electrode located above, causing the particle to jump off the bottom electrode. In the present invention, a multiplicity of V-shaped metallic troughs is installed 0.5 to 3 inches above the planar electrode, and is used as counter electrode. The charged particles jumping off the bottom electrode land on the troughs, move along the length of the troughs, and are collected. Nonconducting particles, which cannot acquire charges by conduction, move along the surface of the bottom electrode, and be separated from the conducting particles. In the process of the present invention, it is not essential to heat the fly ash sample prior to the separation, which is unlike the process described in the U.S. Pat. No. 5,513,755.

The trough electrodes may be installed in parallel to the surface of the planar electrode and transversely from the forward movement of the uncharged particles. They may also be installed with an angle less than 90° to the forward direction in order to facilitate the movement of the charged particles collected at the troughs.

DETAILED DESCRIPTION OF THE INVENTION

Figure 1:
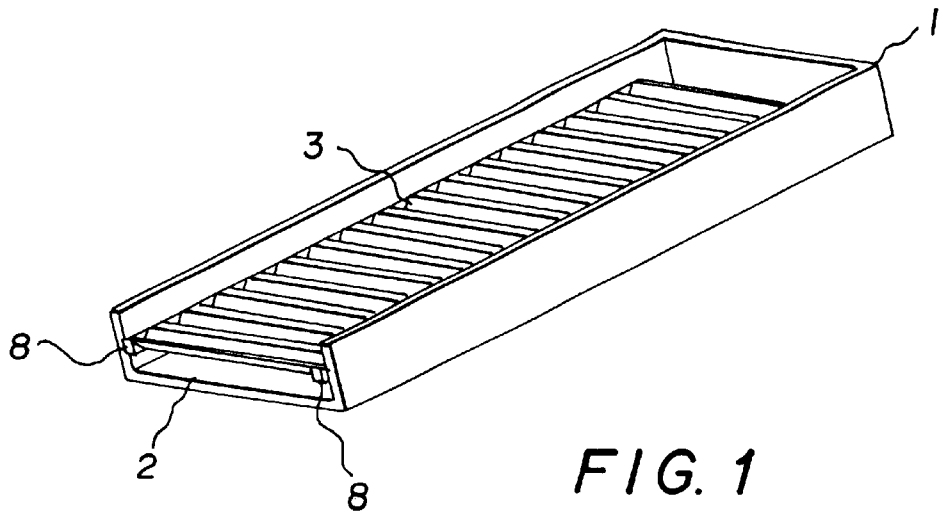
FIG. 1 is a diagram showing, in perspective, the arrangement of the electrodes in an apparatus of the present invention.

In the present invention, one type of particles is separated from another by selectively charging them on the surface of an electrode. The process and apparatus may be depicted in FIGS. 1 to 4, which represent a laboratory unit. The bottom of the separator 1 is made of a 9.8×35.4-inch PVC plate with a ¼-inch thickness. It is laminated with a thin metal plate 2 (e.g., copper, aluminum, and stainless steel) which serves as an electrode. Approximately 1.25 inches above the electrode 2, a set of V-shaped metal troughs 3 is installed, which serves as a counter electrode. It also serves as a collector for the charged particles jumping from the bottom electrode 2. A DC power supply 4 is connected to the upper 3 and the lower 2 electrodes to create a potential difference. The potential difference can vary in the range of 2 kV to 60 kV depending on the charging characteristics of the particles to be separated. The distance between the lower 2 and upper 3 electrodes should be adjusted to prevent the formation of corona charges.

A mixture of particles of different materials 5 is fed to one end of the bottom electrode 2, which may be inclined with an angle 6 to facilitate the materials flow. The angle of slope 6 may be changed to control the feed rate. The whole apparatus is subjected to vibration by means of an electromagnetic vibrator 7 (e.g., Eriez 30S), which is installed underneath the bottom plate 1. The mechanical vibration facilitates: i) forward movement of particles, ii) dispersion of particles to liberate (or detach) them each other, iii) collision of the particles with the bottom electrode to maximize the transfer of electrons between them, and iv) levitation of the charged particles toward the counter electrodes 3.

Figure 4:
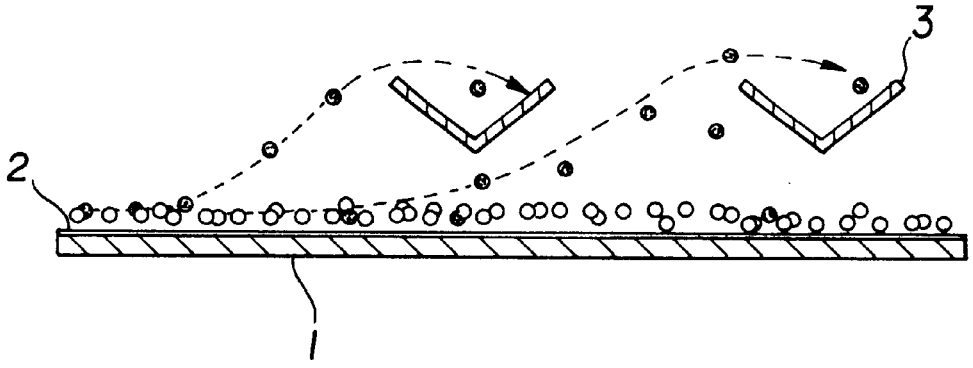
FIG. 4 is a diagram illustrating the movement of charged particles into the upper electrodes.

When a mixture of particles is fed 5 onto one end of the bottom electrode 2, one type of particles acquire surface charge more readily than the other. For conducting particles 8, such as the unburned carbons admixed with fly ash particles, the charges may be acquired by conduction. Nonconducting particles 9, on the other hand, may acquire charges via triboelectrification. For conductors 8, the charges should be of the same sign as that of the bottom electrode 2. When they acquire sufficient charges, they are repelled from the bottom electrode 2 and at the same time attracted by the counter electrodes 3. This will cause the charged particles 8 to jump into the V-shaped trough electrodes 3, as shown in FIG. 4. Non-conducting particles 9, on the other hand, would not be able to exchange electrons with the surface and, hence, continue to move along the surface of the bottom electrode.

For the separation of unburned carbons from fly ash, the best results are obtained when the bottom electrode 2 is polarized negatively and the top electrode 3 positively. In this case, carbon particles 8 acquire a negative charge via conduction mechanism and jump into the trough electrodes 3, while ash particles 9 continue to flow along the surface of the bottom electrode 2. Some of the finer ash particles that have been entrained into the trough electrodes along with the carbon particles crawl over the edges of the V-shaped troughs and fall on to the bottom electrode, providing a scavenging mechanism. It appears that the finer ash particles are being pushed away from the surface of the positive electrode via weak electrostatic repulsion.

In order to provide a more uniform electric field, a screen electrode may be installed over the V-shaped trough electrodes. Both the screen and the trough electrodes are polarized at the same potential.

TEST PROCEDURE

Figure 2:
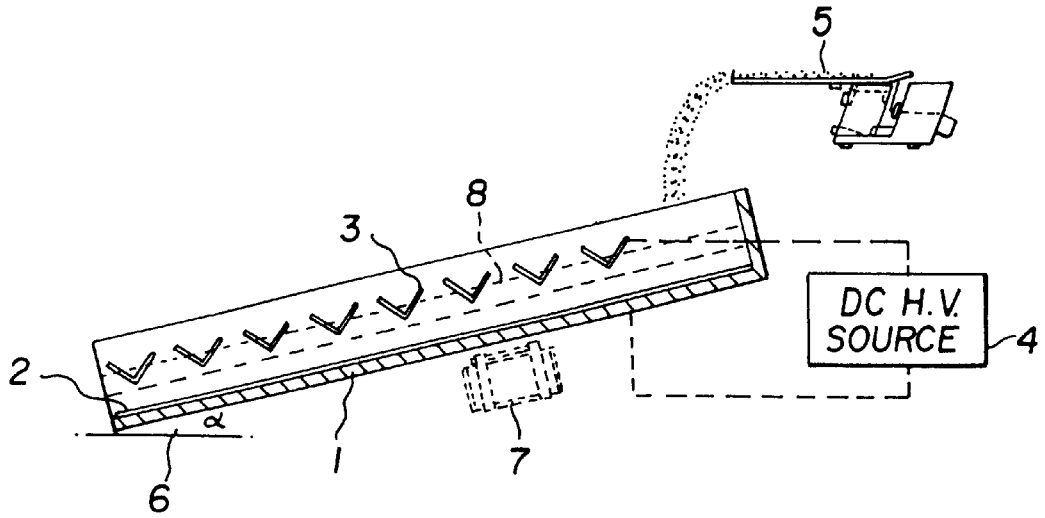
FIG. 2 is a side view of the apparatus, shown in FIG. 1, to illustrate the disposition of the electrodes, the electrical connections, and the feeding arrangement.
Figure 3:
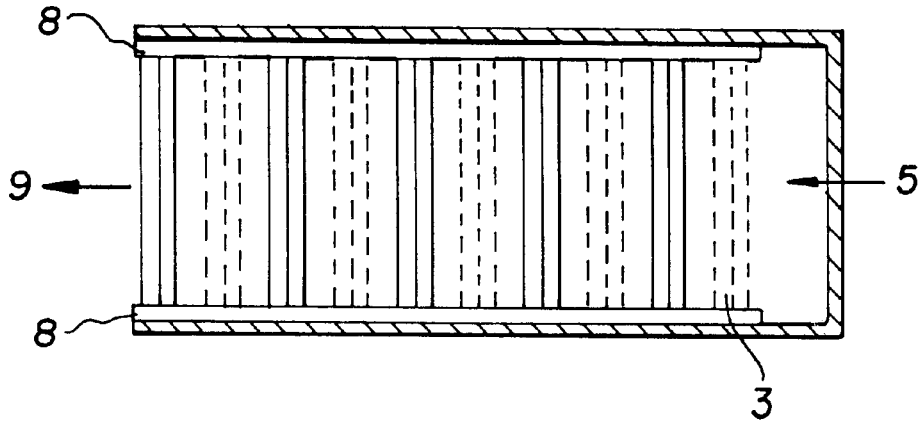
FIG. 3 is a top view of the apparatus, shown in FIG. 1, to illustrate the flow of feed and products.

Most of the tests were conducted using the fly ash samples obtained from the Korea Fly Ash Cement Company. Typically, a 100 grams sample was used in each test. All of the tests were conducted at a potential difference of 30 kV. The process was sensitive to humidity; therefore, all of the tests were conducted at relative humidities of less than 40%. A given test sample was passed through the laboratory separator, which is shown in FIGS. 1 to 3 and described in the foregoing section, several times to improve the extent of carbon removal. Both the carbon and fly ash products were analyzed using the method described in ASTM C114. The LOI values obtained using this method were used to determine the recoveries of fly ash using the standard three-product formula. In this invention disclosure, yields represent weight recoveries.

The separator disclosed in the present invention was also used for separating chalcopyrite and quartz. The test was conducted using an artificial mixture of a −65+100 mesh sample. The products were analyzed by Mountain State R&D International, Inc., Arizona.

EXAMPLES

Example 1

In this example, the electrostatic separator developed in the present invention was tested for removing unburned carbon from fly ash. Since carbon is a conductor, it should be charged by conduction and be removed from fly ash. The test sample was received from Korea Fly Ash and Cement Company. It was dry-screened at 200 mesh, and the screen overflow, assaying 26.6% LOI, was used as feed. The tests were conducted by changing the slope of the plate electrode, which determines throughput. Each test was conducted using a 100-g sample. All tests were conducted with the bottom electrode polarized netatively and with the collection troughs above positively. A potential difference of 30 KV was applied between the two electrodes. Under this condition carbon particles were negatively charged and jumped out of the flowing film of fly ash. Since the length of the table used in the tests was short, it was necessary to pass a given sample several times through the separator to obtain a desired LOI in the product. therefor, one set of tests was conducted by passing a given sample through the separator times, while in another each sample was cleaned four times. The results of the tests are given in Table 1.

As shown, unburned carbons were more readily removed when the angle of slope was low, which may be attributed to the longer residence times for the particles in the electric field. On the other hand, the longer residence times may have allowed some of the fly ash particles to be charged triboelectrostatically and jump into the collection trough along with the carbon particles. Thus, the lower the angle, the lower the product LOI becomes, but at the expense of recovery. At the lowest angle of 11°, the LOI of the ash product was reduced from 26.6 to 3.2% with a recovery of 68.0 % after three passes. After four passes, the LOI was further reduced to 1.6% with a recovery 65.9%. It should be noted here that the number of stages required to obtain a desired LOI should decrease, as the size of the separator becomes larger.

TABLE 1

Effects of Changing the Angle of Slope of the Bottom Electrode on the Separation of a +200 Mesh Fly Ash Sample Assaying 26.6% LOI

| Angle of Slope | 3 Stages Cumulative wt % | | | 4 Stages Cumulative wt% | | |
|---|---|---|---|---|---|---|
| (degrees) | Yield | Recovery | LOI | Yield | Recovery | LOI |
| 11 | 49.4 | 68.0 | 3.2 | 49.2 | 65.9 | 1.6 |
| 16 | 52.8 | 69.5 | 3.5 | 50.1 | 66.7 | 2.2 |
| 18 | 54.8 | 71.4 | 4.4 | 51.0 | 67.4 | 3.0 |
| 21 | 57.2 | 74.0 | 5.0 | 51.9 | 68.5 | 3.2 |
| 23 | 59.3 | 75.4 | 6.7 | 54.1 | 70.6 | 4.3 |
| 26 | 73.2 | 86.7 | 13.0 | 62.3 | 78.7 | 7.3 |

Example 2

In this example, the +200 mesh fly ash sample that was used in Example 1 was cleaned by changing the polarities of the electrodes. In one test, the bottom plate was polarized negatively, and in another it was polarized positively. In both tests, the potential difference was set at 30 KV. As shown in Table 2, unburned carbons were removed substantially only when the bottom electrode was polarized negatively. The poor results obtained when the bottom electrode was polarized positively is not clear.

TABLE 2

Effects of Changing the Polarity of the Bottom Electrode on the Carbon Removal from a +200 Mesh Fly Ash Sample Assaying 26.6% LOI

| | Negative Cumulative wt % | | | Positive Cumulative wt % | | |
|---|---|---|---|---|---|---|
| Stage | Yield | Recovery | LOI | Yield | Recovery | LOI |
| 1 | 93.1 | 95.5 | 24.7 | 94.6 | 96.5 | 25.2 |
| 2 | 79.6 | 86.9 | 20.0 | 92.2 | 94.9 | 24.5 |
| 3 | 59.1 | 74.0 | 8.1 | 90.9 | 94.1 | 24.1 |
| 4 | 51.8 | 69.0 | 2.3 | 89.5 | 93.1 | 23.7 |

Example 3

In this example, the +200 mesh fly ash sample was cleaned five times at 30 KV with the bottom electrode polarized negatively. The results are given in Table 3. It shows that the separation efficiency increased as the number of cleaning stages was increased. This observation may be explained as follows. Although carbon is a condutor, conductivity of the unburned carbon particles present in fly ash may be relativly low. The most likely reason for the low conductivity may be that the surface of the carbon particles may have been oxidized during the process of incomplete combustion in the furnace. The low conductivity may require that unburned carbon particles have multiple contacts with the bottom electrode before they can be sufficiently charged. Nevertheless, the LOI was reduced from 26.2 to 1.3% at a 65.9% recovery after five passes. The recovery can be increased if the rejects are reprocessed.

TABLE 3

Effect of Cleaning a +200 mesh Fly Ash Sample Assaying 26.6% LOI in Multiple Stages

| | Cumulative wt % | | |
|---|---|---|---|
| Stage | Yield | Recovery | LOI |
| 1 | 78.8 | 86.8 | 19.7 |
| 2 | 72.0 | 81.9 | 16.6 |
| 3 | 60.1 | 74.0 | 9.7 |
| 4 | 52.0 | 68.5 | 3.3 |
| 5 | 49.0 | 65.9 | 1.3 |

Example 4

In this example, a fly ash sample from Korea Fly Ash Company was used without pre-screening. Two sets of tests were conducted. In one, the sample was charged before the separation tests, and in another it was fed to the separator without pre-charging. The pre-charging was achieved by passing the feed sample through an air cyclone that was made of Plexiglas. As the carbon particles contact the inner walls of the cyclone, electrons were transferred possibly from Plexiglas to carbon, thereby charging it negatively. This negative charge may have shortened the time required for the carbon particles to acquire sufficient charges for effective separation. Consequently, the test results obtained with the pre-charged sample gave considerably better results. for example, the LOI of the pre-charged sample was reduced to 2.9% after four stages of cleaning 89.3% recovery. With no pre-charging, a 3% LOI product was obtained after 5 stages of cleaning with 80.1% recovery. Thus, a pre-charging technique using a triboelectrification method is helpful for improving the efficiency of the electrostatic separation method described in the present invention disclosure.

TABLE 4

Effect of Pre-charging a Fly Ash Sample Assaying 8.63% LOI Prior to the Electrostatic Separation

| | No charging Cumulative wt % | | | Pre-charging Cumulative wt% | | |
|---|---|---|---|---|---|---|
| Stage | Yield | Recovery | LOI | Yield | Recovery | LOI |
| 1 | 88.3 | 91.9 | 5.0 | 92.0 | 95.9 | 4.8 |
| 2 | 82.5 | 87.0 | 3.7 | 88.6 | 93.5 | 3.6 |
| 3 | 79.5 | 84.1 | 3.2 | 86.2 | 91.4 | 3.1 |
| 4 | 76.3 | 80.9 | 3.1 | 84.1 | 89.3 | 2.9 |
| 5 | 74.0 | 78.6 | 3.0 | 81.1 | 86.3 | 2.8 |

Example 5

A sample received from Korea Fly Ash and Cement Company, assaying 8.6% LOI, was screened at 200 mesh. The screen underflow assayed 4.3% LOI, while the overfow assayed 26.6% LOI. The fine and coarse fractions were cleaned separately. For the test conducted for this example, the electrostatic separator was modified by installing a screen electrode just above the trough electrode. Both the trough and screen were polarized positively, so that the potential difference between the negative (vibrating plate) and positive electrodes was 30 KV. The results obtained with the screen under- and overflows are given in Tables 5 and 6, respectively. With each sample, test were conducted with and without using the screen, and the results are With the −200 mesh sample, the use of the screen electrode in addition to the trough electrode was helpful for removing unburned carbons. As shown in Table 5, the use of the screen electrode increased the recovery at a given product LOI; however, the number of cleaning stages required to obtain a desired LOI tended to increase. For example, the screen electrode reduced the LOI to 3.0% with a recovery of 91.8% after four stages of cleaning. In the absence of the screen, the LOI was reduced to 2.9% at a recovery 87.4% after three stages of cleaning.

TABLE 5

Effect of Using Both Screen and Trough Electrodes on the Separation of a −200 Mesh Fly Ash Sample Assaying 4.3% LOI

| | With Screen Cumulative wt % | | | Without Screen Cumulative wt % | | |
|---|---|---|---|---|---|---|
| Stage | Yield | Recovery | LOI | Yield | Recovery | LOI |
| 1 | 96.5 | 97.2 | 3.7 | 92.7 | 93.7 | 3.3 |
| 2 | 93.4 | 94.4 | 3.2 | 87.9 | 89.1 | 3.0 |
| 3 | 91.2 | 92.4 | 3.0 | 86.2 | 87.4 | 2.9 |
| 4 | 90.6 | 91.8 | 3.0 | 80.4 | 81.7 | 2.8 |
| 5 | 89.0 | 90.3 | 2.9 | 78.8 | 80.1 | 2.7 |

The tests conducted with the +200 mesh fraction gave contrary results. The use of the screen electrode gave poorer results than the case of using the trough electrode alone. In the latter case, it was possible to reduce the LOI to as low as 1.3% with a recovrey of 65.9% after five stages of cleaning. In the former, the product LOI was considerably higher (3.5%) although at a slightly higher (67.6%) recovery after five stages of cleaning. It appeared that the uniform electric field created by the screen is not conducive for lifting larger particles.

TABLE 6

Effect of Using Both Screen and Trough Electrodes on the Separation of a +200 Mesh Fly Ash Sample Assaying 26.6% LOI

| | With Screen Cumulative wt % | | | Without Screen Cumulative wt % | | |
|---|---|---|---|---|---|---|
| Stage | Yield | Recovery | LOI | Yield | Recovery | LOI |
| 1 | 76.8 | 84.5 | 19.3 | 78.8 | 86.2 | 19.7 |
| 2 | 74.2 | 82.8 | 18.1 | 72.0 | 81.9 | 16.6 |
| 3 | 65.0 | 76.9 | 13.3 | 60.1 | 74.0 | 9.7 |
| 4 | 55.9 | 70.8 | 7.1 | 52.0 | 68.5 | 3.3 |
| 5 | 51.4 | 67.6 | 3.5 | 49.0 | 65.9 | 1.3 |

Example 6

Table 7 shows the results obtained with a +200 mesh fly ash sample, assaying 4.0% LOI, by changing the feed rate. The sample was obtained from Korea Fly Ash Company. In general, lower LOI products were obtained at lower feed rates. At a feed rate of 50 g/min, the LOI was reduced to as low as 1.3% at a recovery of 93.8% after five stages of cleaning. At 300 g/min, the product LOI was higher (2.1%) but the recovery was also higher (96.3%). If the product had been subjected to one or two more stages of cleaning, the product LOI would have approached that obtained at the lower feed rate. Thus, the changes in feed rate do not change the grade vs. recovery curve significantly. This finding was also found to be the case with the −200 mesh fraction, although not shown in this example.

TABLE 7

Effect of Feed Rate on the Separation of Unburned Carbon from a Fly Ash Sample Assaying 4.0% LOI

| | 50 g/min Cumulative wt % | | 200 g/min Cumulative wt % | | 300 g/min Cumulative wt % | |
|---|---|---|---|---|---|---|
| Stage | Recovery | L0I | Recovery | LOI | Recovery | LOI |
| 1 | 97.2 | 2.5 | 98.5 | 3.3 | 97.7 | 2.9 |
| 2 | 96.1 | 2.0 | 96.4 | 2.6 | 96.7 | 2.3 |
| 3 | 93.8 | 1.3 | 93.4 | 1.6 | 96.3 | 2.1 |

Example 7

In this example, a fly ash sample from Australia, assaying 0.44% LOI, was used as a feed to the electrostatic separator developed in the present invention. As shown in Table 8, the LOI was reduced to very low levels. After five stages of cleaning, the LOI was reduced to 0.08% with a recovery of 83.8%. This example demonstrated that the separator developed in the present invention can be used for removing small amounts of impurities from particulate materials.

TABLE 8

Removal of Carbon from a Fly Ash Sample Assaying 0.4% LOI

| | Cumulative wt % | | |
|---|---|---|---|
| Stage | Yield | Recovery | LOI |
| 1 | 95.3 | 95.5 | 0.23 |
| 2 | 89.9 | 90.2 | 0.14 |
| 3 | 88.3 | 88.6 | 0.12 |
| 4 | 86.0 | 86.3 | 0.10 |

Example 8

In this example, an artificial mixture of chalcopyrite and quartz was subjected to a separation test. The mixture was prepared by blending −65+100 mesh chalcopyrite and silica powders at a 3:1 ratio. The test was conducted with the bottom electrode polarized negatively. Chalcopyrite particles that are conducting acquired negative charges from the bottom electrode and jumped into the trough electrodes above, while nonconducting quartz particles continued to flow along the bottom electrode. After five stages of cleaning, a copper concentrate assaying 29.8% Cu was obtained, while the silica tailing assayed 0.69% Cu. From these assay values and the feed assay (8.3% Cu), the copper recovery was calculated to be 93.9%. This example demonstrated that the separator developed in the present invention is useful for separating conducting and nonconducting particles form each other.

We claim:

1. An apparatus for separating particulate materials comprising:

a) a planar electrode of generally rectangular shape b) a plurality of V-shaped counter electrodes located above the said planar electrode, c) a hopper to feed the said particulate materials in a layer to one end end of the said planar electrode, d) a vibrator to move the said particulate materials forward bouncing on the surface of the said particulate electrode repeatedly, and e) troughs interconnecting the V-shaped counter electrodes to collect the particulate materials levitated to the said counter electrodes.

2. An apparatus as claimed in claim 1 in which the said V-shaped counter electrodes are replaced by other electrodes of appropriate shapes that can readily collect and retain the particles levitated from the said planar electrode.

3. An apparatus as claimed in claim 1 in which the said V-shaped electrodes are installed at an angle less than 90° to the direction of the forward movement of the particulate material on the said planar electrode.

4. An apparatus as claimed in claim 1 in which the assembly of the said planar electrode and counter electrodes are installed at an angle less than 75° from the horizontal direction.

5. An apparatus as claimed in claim 1 in which a planar screen electrode is installed above the said V-shaped electrode and used as part of the counter electrode that can provide a more uniform field.

6. An apparatus as claimed in claim 1 in which the said plurality of counter electrodes are V-shaped strips of conductors, so that said strongly charged particles lifted from said planar electrodes at ine bottom can be readily collected and moved along the longitudinal axis of the counter electrodes.

7. A method of separating particulate materials of different properties comprising the steps of a) feeding the said particulate materials on to the surface of one end of a planar electrode, which is mechanically vibrated to move the said particulate materials forward, b) allowing the said particulate materials to be bounced repeatedly on the surface of the said planar electrode while they are moving forward, so that at least one type of the material present in the said particulate materials is strongly charged via conduction and/or triboelectrification mechanism(s), while the remainder is weakly charged c) subjecting the said particulate materials in an electric field created between the said planar electrode and a plurality of strips of counter electrodes installed above and in parallel to the said planar electrode, d) allowing the said strongly charged particulate material (s) to be lifted from the flowing film of the said particulate materials moving forward due to the electrostatic repulsion from the said planar electrodes and due to the electrostatic attraction from the said counter electrodes, e) collecting the said strongly charged particles lifted from the said planar electrode directly on the said counter electrodes, and thereby achieving a separation between the said strongly charged particles and the said weakly charged particles.

8. A method as claimed in claim 7 in which the said electric field between the said planar electrode and the said counter electrodes is created by a direct current power supply.

9. A method as claimed in claim 7 in which the said plurality of counter ctrodes are V-shaped strips of conductors, so that the said strongly charged particles lifted from the said planar electrode at the bottom can be readily collected and moved along the longitudinai axis of the counter electrodes.

10. A method as claimed in claim 7 in which a preferred method of the said mechanical virbration is provided by means of an electromagnetic vibrator.

11. A method as claimed in claim 7 in which the said electric field should be at least 2,500 volts per inch of the separation distance between the said planar electrode and said counter electrodes.

12. A method as claimed in claim 7 in which a preferred method of he said mechanical vibration is provided by means of an electromagnetic vibrator.

13. A method as claimed in claim 7 in which the said forward movement of the particulate materials is facilitated by installing the assembly of the said planar electrode and the said plurality of counter electrodes at an angle to the horizontal direction.

14. A method as claimed in claim 7 in which the said particulate materials include the fly ash from coal-burning plants.

15. A method as claimed in claim 7 in which the particulate materials consist of conducting and nonconducting materials.

16. A method as claimed in claim 14 in which a fuiiher step of heating the particulate materials is involved to reduce the moisture from the surface of the said particulate materials.

17. A method as claimed in claim 1 in which a further step of maintaining the ambient relative humidity below 40%.

* * * * *